United States Patent [19]

Frietsch

[11] Patent Number: 4,770,558

[45] Date of Patent: Sep. 13, 1988

[54] INK WRITING OR DRAWING INSTRUMENT

[75] Inventor: Klaus Frietsch, Schramberg, Fed. Rep. of Germany

[73] Assignee: Gebr. Schmidt KG Fabrik Fuer Feinmechanik, Georgen, Fed. Rep. of Germany

[21] Appl. No.: 14,971

[22] Filed: Feb. 9, 1987

[30] Foreign Application Priority Data

Feb. 20, 1986 [DE] Fed. Rep. of Germany ..... 3605458

[51] Int. Cl.[4] ..... B43K 7/00; B43K 7/08

[52] U.S. Cl. ..... 401/209; 401/199; 401/217

[58] Field of Search ..... 401/228, 227, 151, 198, 401/197, 204, 208, 209, 217, 223, 224, 227, 241, 242, 230, 199

[56] References Cited

U.S. PATENT DOCUMENTS

| | | | |
|---|---|---|---|
| 2,187,528 | 1/1940 | Wing | 401/242 X |
| 2,504,649 | 4/1950 | Chesler | 401/217 |
| 2,681,041 | 6/1954 | Zodtner et al. | 401/242 X |
| 2,694,382 | 11/1954 | Miessner | 401/242 X |
| 3,115,119 | 12/1963 | Green . | |
| 3,129,696 | 4/1964 | Makler | 401/217 |
| 3,947,137 | 3/1976 | Hori | 401/217 |
| 4,207,012 | 6/1980 | Kuparinen | 401/242 X |
| 4,509,876 | 4/1985 | Hori | 401/209 X |
| 4,556,336 | 12/1985 | Sano et al. | 401/242 X |
| 4,669,906 | 6/1987 | Narushima et al. | 401/209 |
| 4,712,937 | 12/1987 | Schmidt et al. | 401/209 X |

FOREIGN PATENT DOCUMENTS

| | | | |
|---|---|---|---|
| 3415859 | 7/1985 | Fed. Rep. of Germany . | |
| 1030853 | 6/1953 | France . | |
| 1060105 | 3/1954 | France . | |
| 2072587 | 4/1981 | United Kingdom | 401/242 |
| 2160479 | 12/1985 | United Kingdom . | |

*Primary Examiner*—Richard J. Apley
*Assistant Examiner*—David J. Bender
*Attorney, Agent, or Firm*—Mason, Fenwick & Lawrence

[57] ABSTRACT

In an ink writing instrument, the ink storage space is divided into individual chambers that are inside the housing and are arranged axially one behind one another. The chambers are connected with the writing point by an ink guide. The ink-filled chambers are emptied one after the other by capillaries in the ink guide, air entering the chambers by a ventilation duct in the mouthpiece and the capillary ventilation openings. When ink is removed, no enclosed air volume is formed inside the storage space. In a second embodiment, the chambers are emptied simultaneously, the ventilation duct being opposite the writing point.

9 Claims, 2 Drawing Sheets

INK WRITING OR DRAWING INSTRUMENT

This invention relates to an ink writing or drawing instrument and a capillary flow passage connected to the writing point.

In the case of instruments of this type, two different ink storage systems are used.

In the case of cartridge or plunger-type fountain pens, the ink is located in a chamber or a storage space from which, via an ink-guiding means, it is supplied to the writing point, such as the writing pen. This system has the advantage that the ink can be used up almost completely during the writing process.

It is a significant disadvantage of this system that the volume of the air located in the ink storage space, which follows the ink as it is being used, changes because of outside pressure and temperature fluctuations. These volume changes must be compensated by means of a control system. The usual temperature and pressure fluctuations require a control volume that represents at least one third of the ink container volume. This control volume as a result is then no longer available for the storage of ink. Despite a control means that is dimensioned in this way, more extensive temperature or pressure changes, such as they occur, for example, in air travel at higher altitudes, may result in volume changes of the enclosed air quantity which result in a leaking of the ink from the writing instrument.

An additional disadvantage of this system is that during the writing process, the writing tip must always point downwards.

These disadvantages are at least partially avoided in the case of the other storage system for writing instruments in which the writing fluid is held in a capillary way in a fiber storage means between the fibers. In the case of this storage system, the use of a control means is not necessary. However, in the case of this system, the safety with respect to dripping during stress caused by temperature, pressure or impact is inversely proportional to the filling quantity. In addition this system is not suitable for pigmented ink types.

It is a signficant disadvantage of this system that the ink cannot be used up completely during the writing process because 10 to 15% of the ink located in the storage means is held back by capillary forces. In contrast to an ink writing instrument with ink that is not bound in a capillary way, the ink delivery is not constant over the length of the writing process. As a matter of fact, the ink delivery and thus the line thickness diminishes at the same rate at which the storage means is emptying. The ink delivery is proportional to the filling quantity.

Finally, the mechanically unstable fiber storage means also causes difficulties for technological reasons. Since, in view of the dimensions and particularly the capillarity, it can be produced only with high tolerances, the writing length of these types of writing instruments is subjected to considerable tolerances. In addition, fiber storage means of this type, in the case if improper storage or unfavorable composition, may change their volume and therefore swell or shrink, which may lead to rejects during or after the manufacturing process.

By means of the present invention, an instrument is to be provided that has a storage means that combines the advantages of the two above-mentioned systems while avoiding their disadvantages.

The writing instrument according to the invention ensures a constant ink supply, irrespective of position, temperature and pressure, with a storage volume that is as large as possible.

The invention is an improvement over a known writing instrument which includes an insert used as the ink storage means that is located in the storage chamber of the writing instrument housing, the firm chamber separating walls of said insert delimiting several chambers that are connected with one another and, via an ink guiding means that carries the writing pen, are connected with the writing point. This chamber insert is dimensioned in such a way that the ink is held inside the individual chamber by capillary forces, while the ventilating groove between the individual chamber does not have a capillary effect.

This dimensioning has the significant disadvantage that the individual chambers are emptied simultaneously when the writing instrument is in use and that, because of the capillarity of the chambers, as in the case of the fiber storage means, a residue of ink is always held back. It is a disadvantageous consequence that, as in the case of the writing instruments having fiber storage means, an even and complete emptying of the ink storage means and thus an even thickness of the writing is not ensured until the storage means is empty. In addition, an insert having chambers with capillary effect, is harder to manufacture because of the short distances between the chamber-separating walls, in which case the required large number of separating walls takes up a considerable part of the storage volume.

The permanent ventilating of the chambers via a non-capillary venting duct, in the case of the known writing instrument, has the additional disadvantage that, because of external influences, such as impacts, air bubbles may be formed and placed in the chambers which, in the case of a temperature increase, could also promote the leaking out of the ink.

In order to achieve the above-mentioned objective, the present invention provides that the writing and drawing instrument have multiple storage chambers connected with each other and with a ventilation duct only by one or more capillary ducts.

In contrast to the known solution, the present invention teaches that the individual chambers be dimensioned in such a way that they exercise no capillary forces on the writing fluid and that the ventilating ducts between the chambers be only capillary ducts.

By means of this measure, it is achieved that the chambers individually one after the other are in each case emptied via the ink guiding means. The air that follows into the emptied chambers, in this case, always remains connected to the atmosphere so that volume changes caused by fluctuations of temperature or pressure result in no relative pressure changes within the storage means. A control system is not necessary. Since the chambers of the storage means developed according to the invention do not hold the ink in a capillary way, it can be emptied almost completely which ensures a constant delivery of ink and a high utilization of the stored ink.

With the same dimensions, the storage means according to the invention, compared with a conventional fiber storage means, makes possible a filling capacity that is 50% higher and, compared with systems with free-standing ink, such as a fountain pen, a filling capacity that is 30% higher.

At the same time, the instrument, with respect to its method of operation, is largely independent of its position because the ink is transported to the writing ball or fibers only by means of the capillary forces that are in effect in the ink guiding means. A correspondingly developed writing instrument can also be used when the writing tip points upward or without gravitational forces, and therefore can be used in space.

A feature of the invention is that the chamber insert consists of ring disks with connecting webs that correspond to the height of the chamber, said connecting webs being lined up on the concentrically arranged ink guiding means.

Further, only the chamber-separating wall that is located in front with respect to the writing tip is provided as a ring disk, while the remaining chamber-separating walls have the shape of circular disks, the ink guiding means ending in the chamber that is located in front.

The disks that form the chamber separating walls, via their connecting webs, can be firmly connected with one another and thus form a one-piece chamber insert.

It is also within the scope of the invention to provide several one piece inserts of this type behind one another in the shaft housing, if deemed advisable for functional or manufacturing reasons.

In any case, it must be ensured that only one capillary gap remains between the chamber-separating walls and the interior wall of the shaft housing as well as the ink guiding means. In view of the function of the writing instrument according to the invention, it would also be possible to firmly, and thus absolutely tightly, connect the chamber-Separating walls with the interior wall of the shaft housing9 and in the area of the connection, to provide only a capillary ventilation opening for the connection of the adjacent chambers with one another, to the extent that this development can be manufactured in a rational way.

As mentioned above, the ventilating ducts must have a capillary effect between the chambers.

The ventilating duct that connects these ventilating openings with the atmosphere and which may not be capillary, may be provided in the mouth piece, or in the rear stopper.

The ink guiding means may consist of fiber bundles that have a capillary effect or also of a massive plastic rod with at least one capillary axial duct.

For applying the writing fluid, all conventional writing points are suitable, such as writing points having writing balls felt or fiber writing points or points made of an extruded synthetic material writing pens or small writing tubes.

It is true that the instrument according to the invention is basically intended for writing and drawing, thus for applying ink to an original. However, with a corresponding dimensioning, it is suitable also for applying fluids of other viscosities and composition, for example, for applying lacquers, gels, oils or liquid cosmetics, such as parfumes.

In the following, the object of the invention is described in detail by means of two particularly preferred embodiments that are shown in the drawing.

Figure 1:
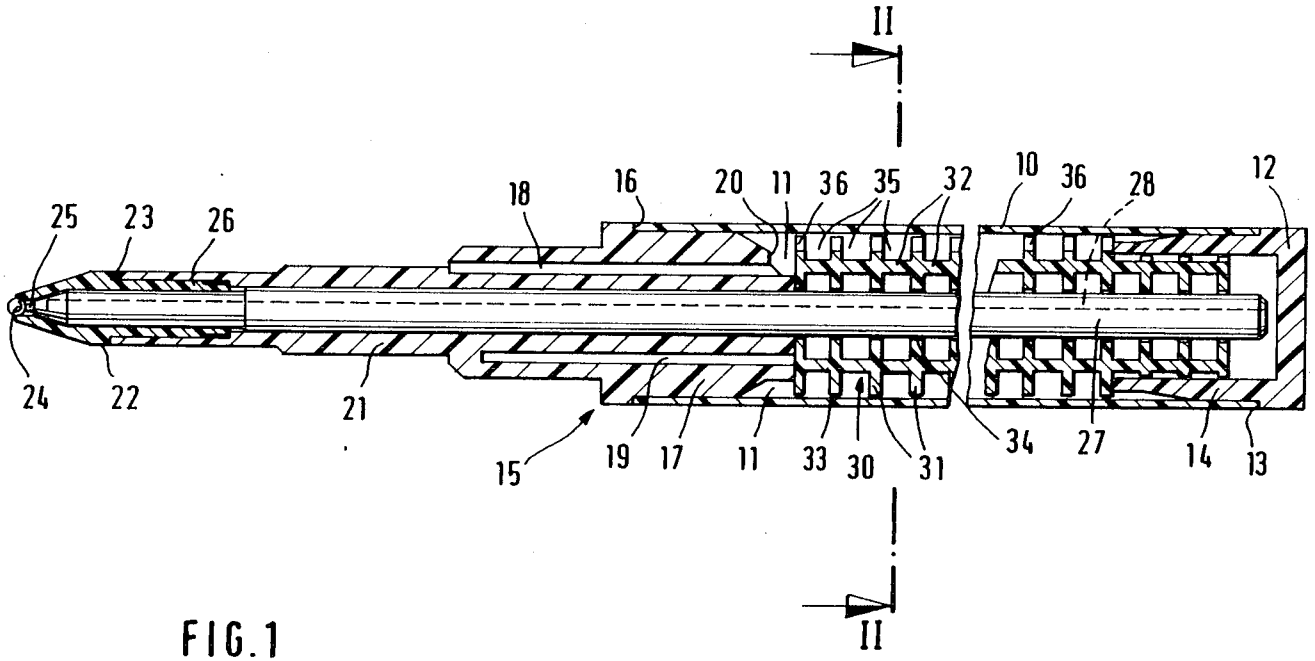
FIG. 1 is an axial section of a writing instrument according to the invention according to a first embodiment.

The ink writing instrument has a shaft housing 10, on the inside of which the writing fluid is stored. The rear end part of the shaft housing 10 is closed by a plug 12 that, with a ring shoulder 13, rests flush on the edge of the housing and, with a sealing and supporting collar 14, projects into the housing.

Into the front end of the shaft housing 10 a mouthpiece 15 is inserted that, also with a ring shoulder 16, rests flush on the edge of the shaft housing and, with a sealing and supporting collar 17, projects into the interior of the housing. Between the plug 12 and the mouthpiece 15, a chamber insert 30 is braced that forms the chambers, the construction and method of operation of said chamber insert 30 being explained in the following. The chamber insert 30 and the mouthpiece 15, particularly its mouthpiece tube 21, are penetrated by a coaxially arranged ink guiding means 27, that projects into a hollow writing point 22. This writing point 22 has an annular shoulder 23 which rests flush against the front end of the mouthpiece tube 21 and has a collar 26 that projects into it and has a writing ball 24 that is disposed in a ball bed provided with feeding capillaries 25. The feeding capillaries 25 that are located between the front end of the ink guiding means 27 and the writing ball 24 and supply the writing ball 24 with the writing fluid, namely ink.

A chamber insert 30 that, in the case of this embodiment, consists of a one-piece molded part has chamber separating walls 31 that are arranged in parallel to one another and are connected with one another via connecting webs 32, said chamber separating walls 31 delimiting individual ring chambers 35 for the receiving of the ink. With respect to the method of operation of the system according to the invention, it is important that the ink is not held by capillary forces between the chamber separating walls 31, but that the chamber separating walls 31 themselves rest as losely as possible against the interior wall of the shaft housing 10 and against the surface of the ink guiding means 27. Since for reasons connected with manufacturing technology, as a rule, a firm, and fluid-tight connection between the separating walls 31 and the shaft housing 10, or the ink guiding means 27 is not possible, only capillary ring gaps 33 and 34 must exist between these parts. The ring chambers 35 are open in the direction of the ink guiding means 27 that receives the present ink via capillaries that are open in the direction of the chambers and transports it, as a result of the capillary forces to the writing point 22. In this case, a massive plastic rod is used as the ink guiding means 27, at least one capillary axial duct 28 being worked into said plastic rod.

For the ventilating of the individual chambers 35, the chamber separating walls 31 are provided with also capillary ventilation openings 36. When ink is used, air, via a ventilating duct 18 and a venilating chamber 19 of the mouthpiece 15, flows into a ventilation chamber 11 and from it, via the respective ventilation openings 36, into that ring chamber 35 that in each case is still filled with ink. The interior slanted edge 20 of the collar 17 located at the mouthpiece 15, on the one hand, supports the chamber insert 30 and, on the other hand, permits the passage of air to the chambers 35 via the ventilation openings 36.

In the case of the arrangement according to the invention, the chamber 35 that is located closest to the writing point 22 is first emptied via the ink guiding means 27. The ink fluid that is taken out of this chamber 35 is replaced by air that is flowing behind it, in which case no air reaches the chamber 35 that follows and is stilled filled with ink, via the capillary passage opening 36.

After the first chamber 35 was emptied, the second one will follow and so on, until all chambers 35 have delivered the stored ink almost without remainder.

In the case of a change in volume of the air, such as due to a change of temperature or pressure of the ambient atmosphere, the compensation always takes place via the ventilation duct 18 and the ventilation chambers 19 and 11 so that, in contrast to the known writing instruments the ink cannot emerge from the ink container under the effect of the pressure.

Figure 2:
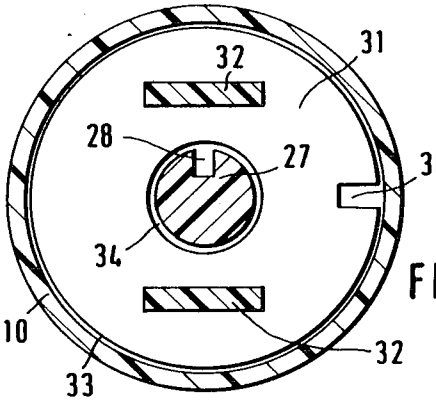
FIG. 2 is a radial section along Line II—II in FIG. 1.
Figure 3:
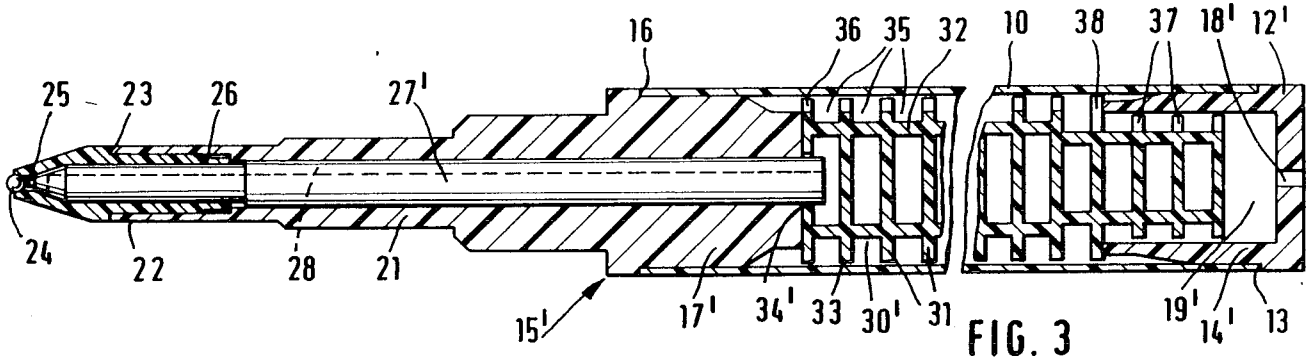
FIG. 3 is an axial section of a writing instrument according to the invention according to a second embodiment.

The ink writing instrument of the invention according to the second embodiment, the axial section of which is shown in FIG. 3, with respect to construction and method of operation corresponds to the first embodiment according to FIGS. 1 and 2.

For an easier understanding and in order to avoid repetitions in the specification, parts that are identical with respect to construction and method of operation have the same numbers and similar parts have primed numbers.

As shown by a comparison of FIGS. 1 and 2, the second embodiment differs from the first embodiment essentially by means of a differently developed chamber insert 30', by means of a shorter ink guiding means 27' and by means of the arrangement of the ventilating duct 18' in the the closing plug 12'.

Also in the case of this form of development, the distance of the chamber separating walls 31 from one another is so large that the latter do not hold the ink in a capillary way, while the chambers 35 are connected with one another and with the ventilation chamber 19' via capillary ventilation openings 36, 37, and 38 and capillary ring gaps 33.

The shorter ink guiding means 27' ends in the ring chamber 35 that with respect to the writing point 22 is located in front and connects said chamber via one or several capillary axial ducts 28, with the writing point 22. During the writing or drawing by means of this writing instrument, ink is also taken from the ring chamber 35 that is located in front. Since, however, the ventilation takes place via the ventilation duct 18' located in the rear plug 14', and the ventilation chamber 19' that is also located in the plug, the chambers that in each case are located in front are supplied with ink via the capillary ventilation openings 36, 37 and the outer capillary ring gaps 33, so that, in contrast to the embodiment according to FIG. 1, the chambers 35 are emptied one after the other from the rear.

Since also in the case of this embodiment of the writing instrument, no closed air space is created, but is always, via the ventilation duct 18', connected with the ambient atmosphere, temperature or pressure changes also do not result in an undesirable leaking-out of ink.

Because of the shorter ink guiding means 27' that must not be led through all ring chambers, this embodiment has advantages with respect to manufacturing technology in comparison to the previously explained embodiment. The shortening of the ink guiding means also reduce the danger of dripping because, in the case of a shorter ink guiding means, possibly enclosed air, when the temperature or the pressure is increased, has less of an effect than in the case of a longer ink guiding means.

The first filling of the writing instrument with air takes place by means of the fact that a vacuum is created in the housing 10 and the ink is sucked in via the mouthpiece 15. This ensures a simple and safe filling in series production.

I claim:

1. An ink writing instrument having a housing with a storage chamber therein for writing fluid, axially spaced separating walls dividing said storage chamber into multiple chambers, a hollow point having a writing ball therein, ink guiding means extending from said storage chamber and into said hollow writing point for connecting the storage chamber and the writing point, said ink guiding means comprising only capillary passage means for guiding ink from said storage chamber into said writing point, a ventilating duct communicating the storage chamber with atmosphere, means consisting of capillary openings for connecting said ventilation duct to the storage chamber and for connecting the multiple chambers with each other, said separating walls being sufficiently spaced from each other so that the writing fluid is not held between them by capillary forces.

2. An ink writing instrument in accordance with claim 1, said separating walls comprising ring discs, connecting webs between said ring discs, said separating walls having bores, and said ink guiding means extending through said bores.

3. An ink writing instrument in accordance with claim 1, wherein the separating wall closest to the writing point has a bore through which said ink guiding means extends, said ink guiding means forming a capillary annular passage with said bore of said separating wall, the other separating walls being without bores, and axially extending webs extending between and connected to said separating walls.

4. An ink writing instrument in accordance with claim 1, wherein the separating walls are connected in series by connecting webs, and wherein said separating walls and connecting webs comprise a one piece insert.

5. An ink writing instrument in accordance with claim 1, wherein said instrument comprises a mouthpiece, said mouthpiece comprising said ventilation duct, a ventilation chamber in said mouthpiece and communicating with said ventilation duct, said capillary openings for connecting the ventilation duct to the storage chamber being in said separating walls.

6. An ink writing instrument in accordance with claim 1, wherein said instrument comprises a rear plug for the housing, a ventilation duct in said rear plug, a ventilation chamber in said instrument adjacent to said rear plug, and at least one of said capillary openings connecting said multiple chambers being in the separating walls.

7. An ink writing instrument in accordance with claim 1, wherein said ventilation openings for said ink are provided between the housing and the edges of said chamber separating walls, and between said bores in said separating walls and the ink guiding means.

8. An ink writing instrument in accordance with claim 1, wherein said ink guiding means comprises first and second linearly extending segments in axial alignment, and means for connecting said segments to each other.

9. An ink writing instrument in accordance with claim 1, wherein said ink guiding means consists of a plastic rod having a capillary axial duct.

* * * * *